US010615484B2

(12) United States Patent
Elford et al.

(10) Patent No.: US 10,615,484 B2
(45) Date of Patent: Apr. 7, 2020

(54) ANTENNA ALIGNMENT DEVICE

(71) Applicant: CenturyLink Intellectual Property LLC, Denver, CO (US)

(72) Inventors: Michael L. Elford, Calhoun, LA (US); Thomas Schwengler, Lakewood, CO (US)

(73) Assignee: CenturyLink Intellectual Property LLC, Broomfield, CO (US)

( * ) Notice: Subject to any disclaimer, the term of this patent is extended or adjusted under 35 U.S.C. 154(b) by 213 days.

(21) Appl. No.: 15/847,419

(22) Filed: Dec. 19, 2017

(65) Prior Publication Data

US 2018/0301802 A1 Oct. 18, 2018

Related U.S. Application Data

(60) Provisional application No. 62/486,859, filed on Apr. 18, 2017.

(51) Int. Cl.

| | |
|---|---|
| ***H01Q 1/18*** | (2006.01) |
| ***H01Q 3/08*** | (2006.01) |
| ***H01Q 1/12*** | (2006.01) |
| ***H01Q 1/00*** | (2006.01) |

(52) U.S. Cl.

CPC ..... *H01Q 1/18* (2013.01); *H01Q 1/005* (2013.01); *H01Q 1/125* (2013.01); *H01Q 1/1257* (2013.01); *H01Q 3/08* (2013.01)

(58) Field of Classification Search

CPC ..... H01Q 1/005; H01Q 1/125; H01Q 1/1257; H01Q 1/18; H01Q 3/08

See application file for complete search history.

(56) References Cited

U.S. PATENT DOCUMENTS

| | | | | | |
|---|---|---|---|---|---|
| 5,359,337 | A * | 10/1994 | Eguchi | H01Q 1/18 | 343/765 |
| 5,512,912 | A * | 4/1996 | Ross | H01Q 1/18 | 343/709 |
| 5,922,039 | A * | 7/1999 | Welch | H01Q 1/34 | 280/5.507 |
| 2018/0277937 | A1* | 9/2018 | Yang | H01Q 1/273 | |
| 2019/0341670 | A1* | 11/2019 | Blennius | H01Q 1/18 | |

* cited by examiner

*Primary Examiner* — Robert Karacsony

(57) ABSTRACT

Novel tools and techniques are provided for implementing antenna alignment, and, more particularly, to methods, systems, and apparatuses for implementing antenna alignment using a gimbal. In various embodiments, a gimbal system might be provided. The gimbal system may be at least one of a passive two-axis gimbal, a passive three-axis gimbal, an active two-axis gimbal, and/or an active three-axis gimbal. At least one antenna may be coupled to the gimbal system. The gimbal system may be configured to compensate for at least one of a movement of a structure and/or a wind load on the at least one antenna. Additionally and/or alternatively, the gimbal system may be configured to align the antenna toward the position and orientation where there is the signal quality is optimized.

13 Claims, 5 Drawing Sheets

ANTENNA ALIGNMENT DEVICE

CROSS-REFERENCES TO RELATED APPLICATIONS

This application claims priority to U.S. Patent Application Ser. No. 62/486,859 (the "'859 Application"), filed Apr. 18, 2017 by Michael L. Elford et al., entitled, "Gimbal Wireless Device for Alignment." The disclosures of this application are incorporated herein by reference in its entirety for all purposes.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to antenna mounting and alignment, and, more particularly, to a gimbal system for antenna alignment.

BACKGROUND

Antennas are commonly attached to utility poles and other tall structures. Conventional means of attachment primarily focus on securing the antenna to these structures, and the orientation of the antenna is subject to the movement of the structures to which the antenna is mounted. For example, as poles and other structures tend to sway and move due to wind, and expand and contract due to changes in temperature, antennas are subject to the movement of the structure to which it is attached.

Additionally, antennas may experience significant wind load because of their surface area. The wind load may cause the antennas to sway and move and a direction of transmission (and/or reception) may be difficult to maintain.

Hence, more robust solutions for antenna mounting and alignment are provided.

BRIEF DESCRIPTION OF THE DRAWINGS

A further understanding of the nature and advantages of particular embodiments may be realized by reference to the remaining portions of the specification and the drawings, in which like reference numerals are used to refer to similar components. In some instances, a sub-label is associated with a reference numeral to denote one of multiple similar components. When reference is made to a reference numeral without specification to an existing sub-label, it is intended to refer to all such multiple similar components.

DETAILED DESCRIPTION OF CERTAIN EMBODIMENTS

Overview

Figure 1:
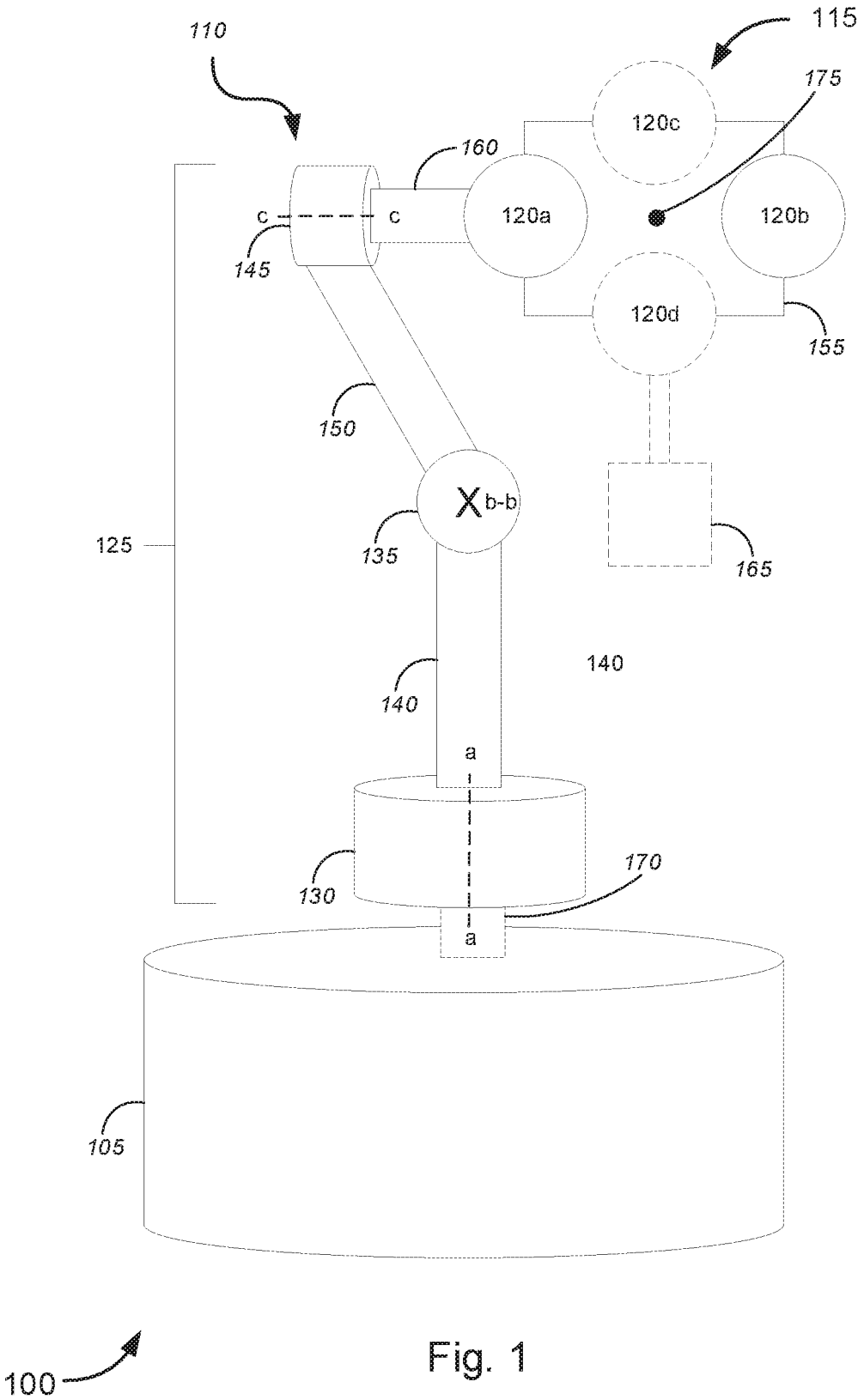
FIG. 1 is a schematic diagram illustrating a system for antenna alignment using a gimbal, in accordance with various embodiments.

Various embodiments provide tools and techniques for implementing antenna alignment, and, more particularly, methods, systems, and apparatuses for implementing antenna alignment using a gimbal.

The following detailed description illustrates a few exemplary embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. In other instances, certain structures and devices are shown in block diagram form. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers used herein to express quantities, dimensions, and so forth used should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

In an aspect, an apparatus might include a gimbal. The gimbal may have a first joint configured to allow rotation about a first axis and a second joint configured to allow rotation about a second axis. The second joint may be coupled to the first joint via a first member. The gimbal may additionally include a mount coupled to the second joint via a second member. The first joint and the second joint may be configured to allow the mount to pivot about the first axis and the second axis.

In some embodiments, the apparatus might further include an antenna coupled to the mount of the gimbal. The antenna may include at least two antenna elements. Each of the at least two of antenna elements may be disposed on opposite sides of the mount substantially equidistant from a center of the mount.

The apparatus may further have a base. The base may be coupled to the first joint. The base may further be attached to, without limitation, one of a utility pole, a tower, a building, a house, a tree, a wire, a cable, a support line, or other vertical, erect, and/or hanging structure. The utility pole, a tower, a building, a house, a tree, a wire, a cable, a support line, or other vertical, erect, and/or hanging structure may sway in the wind, move due to variations in temperature, and or move due to movement of the ground underlying the structure.

According to some embodiments, the gimbal may further include a third joint coupled to the first joint via a third member. The third joint may be configured to rotate about a third axis. The third joint may also be configured to allow the mount to pivot about the third axis.

Merely by way of example, the gimbal may further have a counterweight coupled to the mount of the gimbal. The counterweight may be configured to shift a center of gravity of the gimbal to a point between the mount and an end of the counterweight and maintain a constant direction of the mount/antenna. The counterweight may have a vertical reference the ground and cause the gimbal to maintain the antenna in a constant direction.

The at least two antenna elements coupled to the mount may be configured to offset wind load about the center of the mount. In order to offset the wind load, the two antenna elements may be identical in at least one of size, shape, and/or weight such that wind force on a first antenna element cancels out the wind force on the second antenna element. By cancelling out the wind force, the antennas are able to maintain a constant direction of transmission.

The antenna elements may be, without limitation, one of spatially diverse, pattern diverse, polarization diverse and/or transmit/receive diverse. The antenna may further include a plurality of lateral patch antennas, a plurality of arrays of patch antennas, one or more micro-strip patch antennas, a two-dimensional ("2D") leaky waveguide antenna, or a three-dimensional ("3D") array of the at least two antenna elements.

In additional embodiments, the apparatus may further include a first driver operably coupled to the first joint and a second driver operably coupled to the second joint. The first driver might cause the first joint to rotate about the first axis. The second driver might cause the second joint to rotate about the second axis. The first driver and second driver may be configured to maintain an orientation of the antenna. Maintaining the orientation of the antenna may include compensating for at least one of a yaw, a roll, or a pitch of the antenna and maintaining a direction of the antenna.

In some additional embodiments, the apparatus may include one or more sensors coupled to the gimbal and a controller communicatively coupled to the one or more sensors and the first driver and the second driver. The controller may receive input from the one or more sensors about the orientation of the antenna. Based on the information received from the one or more sensors, the controller might cause at least one of the first driver or the second driver to move to maintain a target position and a target orientation of the antenna.

The apparatus may also include a base coupled to the first joint via a third member. The base may then be coupled to a pole. The orientation of the mount may change in response to a swaying (yaw, pitch, and/or role) of the pole and the controller may maintain the target position and the target orientation of the mount and compensate the movement of the pole.

In another aspect, a system may include a gimbal. The gimbal may include a first joint configured to allow rotation about a first axis and a first driver operably coupled to the first joint. The gimbal may further include a second joint configured to allow rotation about a second axis and a second driver operably coupled to the second joint. The second joint may be coupled to the first joint via a first member. A mount may be coupled to the second joint via a second member. The first joint and second joint might be configured to allow the mount to pivot about the first axis and the second axis. Additionally, the first driver and second driver might be configured to maintain a target position and a target orientation of the mount. In order to maintain the target position and the target orientation of the mount, the first driver may be configured to cause the first joint to rotate about the first axis and the second driver may be configured to cause the second joint to rotate about the second axis.

In some embodiments, the system may further include one or more sensors coupled to the gimbal and an antenna coupled to the mount of the gimbal. The antenna may include at least one antenna element.

The system might additionally include a controller communicatively coupled to the one or more sensors and the one or more drivers of the gimbal. The controller might include at least one processor and a non-transitory computer readable medium communicatively coupled to the at least one first processor, the non-transitory computer readable medium may have stored thereon computer software comprising a set of instructions that may be executed by the at least one processor.

When the instructions are executed by the processor, the controller might first determine the target position and the target orientation of the mount. Next, the controller might determine, based on input from the one or more sensors, an actual position and an actual orientation of the mount. Additionally, the controller might determine whether the actual position and the actual orientation of the mount deviate from the target position and the target orientation of the mount. Based on a determination that the target position and the target orientation of the mount and the actual position and the actual orientation of the mount deviate, the controller might send instructions to at least one of the first driver or the second driver to cause at least one of the first driver or the second driver to rotate at least one of the first joint or second joint to about at least one of first axis or the second axis to maintain the mount in the target position and the target orientation.

The one or more sensors might include, without limitation, one of one or more positional sensors, one or more temperature sensors, one or more accelerometers, one or more gyroscopes, one or more position sensors, one or more magnetometers (e.g., compass), one or more global positioning systems, one or more cameras, one or more vibration sensors, one or more wind sensors, one or more seismic sensors, one or more signal sensors, and/or sensors used to detect a change in movement or position.

In order to maintain the target position and the target orientation of the antenna, the controller may send instructions to at least one of the first driver or the second driver to compensate for at least one of a yaw, a roll, or a pitch of the mount and maintain the target position and the target orientation of the mount.

In order to set the target position and the target orientation of the mount/antenna, the controller may receive an input from a user indicating an initial position and an initial orientation of the mount and set the initial direction as the target position and the target orientation of the mount. The initial orientation may be received from a technician/user setting up the antenna. The initial orientation might be changed by periodically by a technician/user.

Additionally and/or alternatively, in order to set the target orientation of the mount/antenna, the controller may receive input from the one or more sensors indicating a signal quality (e.g., signal strength, noise, etc.) corresponding to a plurality of positions and a plurality of orientations of the mount. The controller may then determine one position from among the plurality of positions and one orientation from among the plurality of orientations where the signal quality is optimized (e.g., where the signal strength is greatest, where there is the least amount of noise, etc.). Based on a determination of the position and orientation where the signal quality is optimized, the controller may set the one position and one orientation where the signal quality is optimized as the target position and the target orientation of the mount.

In some embodiments, the system may further include a stationary base coupled to the first joint via a third member. The stationary base may be configured to couple to a pole.

The system might also include an antenna coupled to the mount of the gimbal, the antenna including at least two antenna elements, wherein the at least two of antenna elements are disposed on opposite sides of the mount substantially equidistant from a center of the mount. The antenna elements may be configured to offset a wind load.

In an additional aspect, a method of maintaining a fixed direction of transmission/reception of a signal may be provided. The method may include providing a gimbal. The gimbal might include a first joint configured to allow rotation about a first axis and a second joint configured to allow rotation about a second axis. The second joint may be coupled to the first joint via a first member. The gimbal may further include a mount coupled to the second joint via a second member. The first joint and second joint might be configured to allow the mount to pivot about the first axis and the second axis.

The method might further include mounting the gimbal to at least one of a building, a tower, a pole, a tree, a wire, a cable, or a support line. Additionally, the method might include maintaining, with the gimbal, a target position and a target direction of the mount and the antenna. The gimbal might be used to compensate for a movement of at least one of a building, a tower, a pole, a tree, a wire, a cable, or a support line. Additionally and/or alternatively, the gimbal might be used to compensate for a wind force on the mount/antenna.

Various modifications and additions can be made to the embodiments discussed without departing from the scope of the invention. For example, while the embodiments described above refer to particular features, the scope of this invention also includes embodiments having different combination of features and embodiments that do not include all of the above described features.

SPECIFIC EXEMPLARY EMBODIMENTS

The methods, systems, and apparatuses illustrated by FIGS. 1-5 refer to examples of different embodiments that include various components and steps, which can be considered alternatives or which can be used in conjunction with one another in the various embodiments. The description of the illustrated methods, systems, and apparatuses shown in FIGS. 1-5 is provided for purposes of illustration and should not be considered to limit the scope of the different embodiments.

FIG. 1 is a schematic diagram illustrating a system 100 for antenna alignment using a gimbal, in accordance with various embodiments. The system 100 may include a structure 105, a gimbal 110, and an antenna(s) 115. The antenna(s) 115 may further include antenna element(s) 120*a-d* (collectively, antenna element(s) 120). The gimbal 110 may be configured to couple to the antenna(s) 115 such that a position and orientation of the antenna(s) 115 may be changed via manipulation of the gimbal 110. The gimbal 110 may further be configured to fix a position and orientation of the antenna(s) 115. For example, the gimbal 110 may be configured to cause the antenna(s) 115 to maintain a fixed position and orientation. A fixed position and orientation of the antenna(s) may include, without limitation, maintaining a fixed position in three-dimensional space, or maintaining a direction of transmission and reception of antenna(s) 115 (e.g., keeping the antenna(s) 115 facing a specified direction). The gimbal 110 might further be configured to maintain an orientation of the antenna(s) 115 during movement of the structure 105, and/or responsive to wind load on the antenna(s) 115 and/or antenna element(s) 120*a-d* causing movement of the antenna(s) 115 or antenna element(s) 120 themselves. For example, in some embodiments, the gimbal 110 may be configured to compensate for the movement of the antenna(s) 115 or structure 105.

In various embodiments, the structure 105 may be, without limitation, one of a utility pole, a tower, a building, a house, a tree, a wire, a cable, a support line, or other vertical, erect, and/or hanging structure. Accordingly, structure 105 might sway or otherwise move due to wind, movement of the ground underlying the structure 105, and/or expand/contract due to changes in temperature. The movement of the structure 105 may cause the antenna(s) 115 to move in three-dimensional space (e.g., positional change). In various embodiments, the movement of the antenna(s) 115, caused by movement of the structure 105, may be compensated for by adjusting the gimbal 110. In further embodiments, the orientation of the antenna(s) 115 may also be caused to change (e.g., directional change) by movement of the structure 105. The change in the orientation of the antenna(s) may similarly be compensated for by the gimbal 110. For example, the direction in which the antenna(s) 115 face may be changed by movement of the structure. Accordingly, the gimbal 110 may compensate for the directional change of the antenna(s) 115 by manipulating the yaw, pitch, and/or roll of the antenna(s) 115.

In some embodiments, the gimbal 110 may be coupled to the structure 105 at base 170. The gimbal 110 may further be coupled to antenna(s) 115 via mount 155. Thus, the gimbal 110 may be configured to mount the antenna(s) 115 to the structure 105 in a manipulatable manner. The gimbal 210 may be configured to be raised and lowered from structure 205 for alignment, repair, and/or maintenance. In a non-limiting example, the gimbal 110 may be configured to be mounted to a structure 105 such that the gimbal 110 may be translated up and down relative to the structure 105 (like a flag on a pole). The structure 205 may further include an arm to raise and lower the gimbal for maintenance. Additionally and/or alternatively, the gimbal 110 itself may be foldable at the joints (130, 135, 145) such that a technician, installer, etc. can reach the antenna(s) 115 attached to a mount 155 of the gimbal.

In various embodiments, the gimbal 110 may be configured to compensate for at least part of the movement of the structure 105. For example, the gimbal 110 may be configured to adjust a position of the antenna(s) 115 in three-dimensional space (e.g., positional change), and additionally or alternatively, maintain a fixed orientation of the antenna(s) 115 by adjusting one or more of the yaw, pitch, and/or roll of the antenna(s) 115 (e.g., directional change). In some further embodiments, the directional and positional changes may correspond to maintaining a direction of transmission and/or reception of the antenna(s) 115.

In various embodiments, the gimbal 110 may be a passive gimbal with components that maintain the antenna(s) 115 direction of transmission and/or reception. Gimbal 110 might include a pivoted support structure 125 with two or more orthogonal pivot axes which allow an object (such as antenna(s) 115) mounted on the gimbal 110 to be manipulated in three dimensions. In some embodiments, the gimbal 110 may be operable to allow the position and orientation of the antenna(s) 115 to remain independent of the movement of structure 105. In other words, as the structure 105 moves, the pivoted support structure 125 of the gimbal 110 may rotate around respective pivot axes to compensate for changes in the position and direction of the antenna(s) 115 caused by movement of the structure 105. This may include manipulation of the pivoted support structure 125 to maintain a position in three-dimensional space, or a constant direction of transmission (and/or reception) by adjustment of the yaw, pitch, and/or roll of the antenna(s) 115.

By way of example, in some embodiments, the gimbal 110 may be a passive two-axis gimbal. The pivoted support structure 125 of the passive two-axis gimbal might include a first joint 130 configured to allow rotation about a first axis a-a and a second joint 135 configured to allow rotation about a second axis b-b (shown going into the page). The first joint 130 may be coupled to a first member 140 at a first end, and the second joint 135 may be coupled to the first member 140 at a second end. Thus, the first joint 130 and second joint 135 may be connected via the first member 140. The first joint 130 and/or second joint 135 may include various types of suitable rotating joints, including without limitation, a ball joint, a hinge joint, or various types of bearings, such as, without limitation, ball bearings, or flexure bearings. The passive two-axis gimbal may be configured to adjust at least two of a yaw, pitch, and/or roll of the antenna(s) 115 to compensate for movement of the structure 105. Thus, the gimbal 110 may be configured to prevent directional changes of the antenna(s) 115 (e.g., changes in the direction the antenna(s) 115 are facing) coupled to the pivoted support structure 125, by adjusting for movement around the at least two axes.

As previously described, the first joint 130 may be coupled to a base 170 that attaches to the structure 105. In various embodiments, the base may couple the gimbal 110 to the structure 105. The base 170 may, in some examples, be part of the first joint 130. In other words, the first joint 130 may be directly coupled to structure 105. Additionally and/or alternatively, the base 170 may be separate from the first joint 130 and operatively couple the first joint 130 to structure 105.

In further embodiments, the gimbal 110 may be a passive three-axis gimbal. The pivoted support structure 125 of the passive three-axis gimbal might include a first joint 130 configured to allow rotation about a first axis a-a and a second joint 135 configured to allow rotation about a second axis b-b (shown going into the page). The first joint 130 and the second joint 135 may be coupled together by a first member 140. The pivoted support structure 125 may further include a third joint 145 configured to allow rotation about a third axis c-c. The second joint 135 may be coupled to a second member 150 at a first end and the third joint 145 may be coupled to the second member 150 at a second end. Thus, the second joint 135 and third joint 145 may be connected via the second member 150. The first joint 130, second joint 135, and/or third joint 145 may include various types of suitable rotating joints, including without limitation, a ball joint, a hinge joint, or various types of bearings, such as, without limitation, ball bearings, or flexure bearings. The passive three-axis gimbal 110 may be configured to compensate for a positional change or a directional change of the antenna(s) 115. For example, the gimbal 110 may be configured to adjust for positional changes in three-dimensions of the antenna(s) 115, or a directional change of the antenna(s) 115 by adjusting a yaw, pitch, and roll of the antenna(s) 115. The antenna(s) 115 may therefore be coupled to the pivoted support structure 125 via the gimbal 110.

As previously described, the first joint 130 of the passive three-axis configuration of the gimbal 110 may be coupled to the base 170, which may in turn be attached to the structure 105. In further embodiments, the gimbal 110 may include a mount 155. The mount 155 may be coupled directly to the second joint 135 and/or the second member 150 of the passive two-axis gimbal (not shown in FIG. 1). Alternatively, mount 155 may be coupled directly to the third joint 145 and/or the third member 160 of the passive three-axis gimbal.

The first joint 130, the second joint 135, and the third joint 145 may be configured to rotate about the first axis a-a, the second axis b-b, and the third axis c-c, respectively. In various embodiments, the antenna(s) 115 may be coupled to the mount 155 such that movement of the antenna(s) 115 relative to the mount 155 is restricted. Thus, the gimbal 110 may be configured to manipulate the antenna(s) 115 via adjustment of the mount. In other words, as the first joint 130, the second joint 135, and/or the third joint 145 rotate about the first axis a-a, the second axis b-b, and/or the third axis c-c, respectively, the mount 155 may be manipulated to compensate for movement in three-dimensional space, and/or to compensate for changes in the orientation of the mount 155, and by extension antenna(s) 115. For example, in some embodiments, compensating for positional changes (e.g., movement in three-dimensional space) may include maintaining a substantially static position in space by rotation of one or more of the first, second, and third joints 130, 135, 145. In some embodiments, movement of the structure 105 may be compensated at least partially in three-dimensions by rotation of one or more of the first, second, and third joints 130, 135, 145. For example, if the structure 105 moves in a first direction, the gimbal 110 may compensate for this movement by adjusting the position of the mount 155 (and in turn antenna(s) 115), at least partially, in an opposite direction to the first direction. In various embodiments, compensation for positional changes may occur dynamically with the movements of the structure 105. Similarly, directional changes introduced by the movement of the structure 105 may be compensated for by the gimbal 110. This may include, for example, maintaining a substantially static orientation of the mount 155, and by extension antenna(s) 115, dynamically with the movement of the structure 105. For example, if movement of the structure 105 causes a shift in the orientation of the mount 155 (and antenna(s) 115) in one or more of a yaw, pitch, or roll axes, the gimbal 110 may compensate for these changes by at least partially adjusting the yaw, pitch, or roll axes of the mount 155 in the opposite direction. In some embodiments, the gimbal 110 may be configured to maintain a substantially static orientation of the mount 155, and by extension the antenna(s) 115.

In some embodiments, one or more antenna(s) 115 may be coupled to mount 150. By way of example, the antenna(s) 115 may include, without limitation, at least one of a lateral patch antenna, patch antenna array, micro-strip patch antenna, a two-dimensional ("2D") waveguide antenna, a three-dimensional ("3D") antenna array, dipole antenna, and/or a parabolic antenna. In some cases, at least one of the antenna(s) 115 might include one or more antenna element(s) 120*a-d* (collectively, antenna element(s) 120).

According to embodiments, the antenna(s) 115 and/or antenna element(s) 120 might each transmit and receive various radio frequency (RF) signals, such as, without limitation, microwave, millimeter wave, very high frequency (VHF), ultra-high frequency (UHF), extremely high frequency (EHF), and other RF, wireless, or cellular signals in other bands. For example, RF signals may include, without limitation, wireless broadband signals according to a set of protocols comprising at least one of IEEE 802.11a, IEEE 802.11b, IEEE 802.11g, IEEE 802.11n, IEEE 802.11ac, IEEE 802.11ad, and/or IEEE 802.11af. Alternatively, or additionally, the antenna(s) 120 might each transmit and/or receive RF signals according to a set of protocols comprising at least one of Universal Mobile Telecommunications System ("UMTS"), Code Division Multiple Access ("CDMA"), Time Division Multiple Access ("TDMA"), Global System for Mobile Communication ("GSM"), Long Term Evolution ("LTE"), Personal Communications Service ("PCS"), Advanced Wireless Services ("AWS"), Emergency Alert System ("EAS"), Citizens Band Radio Service ("CBRS"), and/or Broadband Radio Service ("BRS").

In some embodiments, when antenna(s) 115 and/or antenna element(s) 120 are mounted to structure 105 via gimbal 110, the antenna(s) 115, the antenna element(s) 120, and/or the mount 155 may experience wind load. The wind load on the antenna(s) 115, antenna element(s) 120, and/or mount 155 may cause movement in the position or orientation (e.g., direction) of the antenna(s) 115, antenna element(s) 120, and/or mount 155. To address the effects of wind load on the position or orientation of the antenna(s) 115, antenna element(s) 120, and/or mount 155, at least two antenna(s) 115 and/or at least two antenna element(s) 120 may be coupled to the mount 155, such that a wind load on one or more antenna(s) 115 or one or more antenna element(s) 120 is offset by the one or more of the other antenna(s) 115 or antenna element(s) 120. Additionally and/or alternatively, a counterbalance may be used to offset wind load on an antenna 115 and/or antenna element 120. The counterbalance may include, but is not limited to, an antenna, an antenna element, a weight, a dummy element, a stabilizer, or other counterbalances. For example, the at least two antenna(s) 115, at least two antenna element(s) 120, at least one antenna 115 and at least one counterbalance, and/or at least one antenna element 120 and at least one counterbalance, may be mounted such that the antenna(s) 115, antenna element(s) 120, and/or counter balances offset wind load about a center 175 of the mount 155. In some embodiments, the at least two antenna(s) 115, the at least two antenna element(s) 120, the at least one antenna 115 and the at least one counterbalance, and/or the at least one antenna element 120 and the at least one counterbalance may be disposed equidistant from a center 175. Although offsetting wind load is described below with respect to antenna element(s) 120, similar techniques may be applied to one or more antenna(s) 115 or antenna arrays.

One way to offset wind load, is to provide a first antenna element 120*a* and a second antenna element 120*b* on opposite sides of the mount 155. The first antenna element 120*a* and the second antenna element 120*b* may be substantially equidistant from a center 175 of the mount 155. Antenna elements 120*a* and 120*b* may be identical (e.g., identical in at least one of size, shape, and/or weight). By providing identical antenna elements on opposite sides of the mount 155 substantially equidistant from a center of the mount 155, the wind load on antenna element 120*a* may be offset by the wind load on antenna element 120*b* and the antenna element(s) 120*a* and 120*b* are able to maintain a constant direction of transmission (and/or reception).

In some embodiments, in addition to elements 120*a* and 120*b*, or alternatively, a third antenna element 120*c* and a fourth antenna element 120*d* may be provided on opposite sides of the mount 155. The third antenna element 120*c* and the fourth antenna element 120*d* may be substantially equidistant from a center 175 of the mount 155, the third antenna element 120*c* located above the center 175 of the mount 155 and the fourth antenna element 120*d* located below the center 175 of the mount. In some embodiments, antenna elements 120*c* and 120*d* may be identical (e.g., identical in at least one of size, shape, and/or weight). By providing identical antenna elements on opposite sides of the mount 155 substantially equidistant from a center 175 of the mount 155, the wind load exerted on antenna element 120*c* may be offset by the wind load exerted on antenna element 120*d*, such that movement of the antenna(s) 115 in one of a yaw, pitch, or roll axes are mitigated.

In additional embodiments, an antenna element 120*a* and a counterbalance may be provided on opposite sides of the mount 155. The counterbalance may be substituted for antenna element 120*b*. The first antenna element 120*a* and the counterbalance may be substantially equidistant from a center 175 of the mount 155. The first antenna element 120*a* and the counterbalance may be identical (e.g., identical in at least one of size, shape, and/or weight). By providing an antenna element 120*a* and a counterbalance on opposite sides of the mount 155 substantially equidistant from a center of the mount 155, the wind load on antenna element 120*a* may be offset by the wind load on the counterbalance and the antenna element 120*a* may be able to maintain a constant direction of transmission (and/or reception).

It is to be understood that the examples provided herein are not to be taken as limiting. For example, the above examples should not be taken as limiting the number of antennas 115, antenna element(s) 120, and/or counterbalances that may be placed on the mount 155. In other examples, two or more antenna(s) 115, antenna elements 120, and/or counterbalances may be placed in the center of the mount 155 to offset the wind load about a center of the mount 155, including odd numbers of antenna(s) 115, antenna element(s) 120, and/or counterbalances.

Several additional advantages may be realized by using at least two antenna(s) 115 and/or antenna element(s) 120 to offset the wind load about a center of the mount 155. For example, the at least two antenna(s) 115 and/or antenna element(s) 120 may be used for a redundant system (e.g., when retransmission is needed, the system may switch from antenna element 120*a* to antenna element 120*b*). Additionally and/or alternatively, at least two antenna(s) 115 and/or antenna element(s) 120 may be used for diversity. The at least two antenna(s) 115 and/or antenna element(s) might be at least one of spatially diverse, pattern diverse, polarization diverse, and/or transmit/receive diverse. Spatial diversity employs multiple antennas/antenna elements, usually with the same characteristics, that are physically separated from one another. Pattern diversity consists of two or more co-located antennas/antenna elements with different radiation patterns. Polarization diversity combines pairs of antennas/antenna elements with orthogonal polarizations. Transmit/receive (Tx/Rx) diversity uses two separate, co-located antennas/antenna elements for transmit and receive functions.

In some embodiments, gimbal 110 may further be coupled to a counterweight 165 coupled to the mount 155. The counterweight 165 may be used to stabilize the mount 155, antenna(s) 115, and/or antenna element(s) 120. The counterweight may shift the center of gravity to a point between the mount 155 and an end of the counterweight 165 and provide a "zero gravity" effect on the mount 155. The "zero gravity" effect ensures that the mount 155 and the antenna(s) 115 attached to the mount 155 maintain a constant direction of transmission (and/or reception). The counterweight 165 may include a heavy pendulum that is mounted on the mount 155.

In some embodiments, the counterweight 165 may be attached to the mount 155 such that the counterweight 165 maintains a vertical reference to the ground even as the structure 105 sways/moves. By maintaining a vertical reference to the ground, the pivoted support structure 125 of the gimbal 110 allows the mount 155 and/or the antenna(s) 115 to maintain a constant direction of transmission (and/or reception) independent of the movement/sway of the support structure 105.

These and other functions of the system 100 (and its components) are described in greater detail below with respect to FIGS. 2-5.

Figure 2:
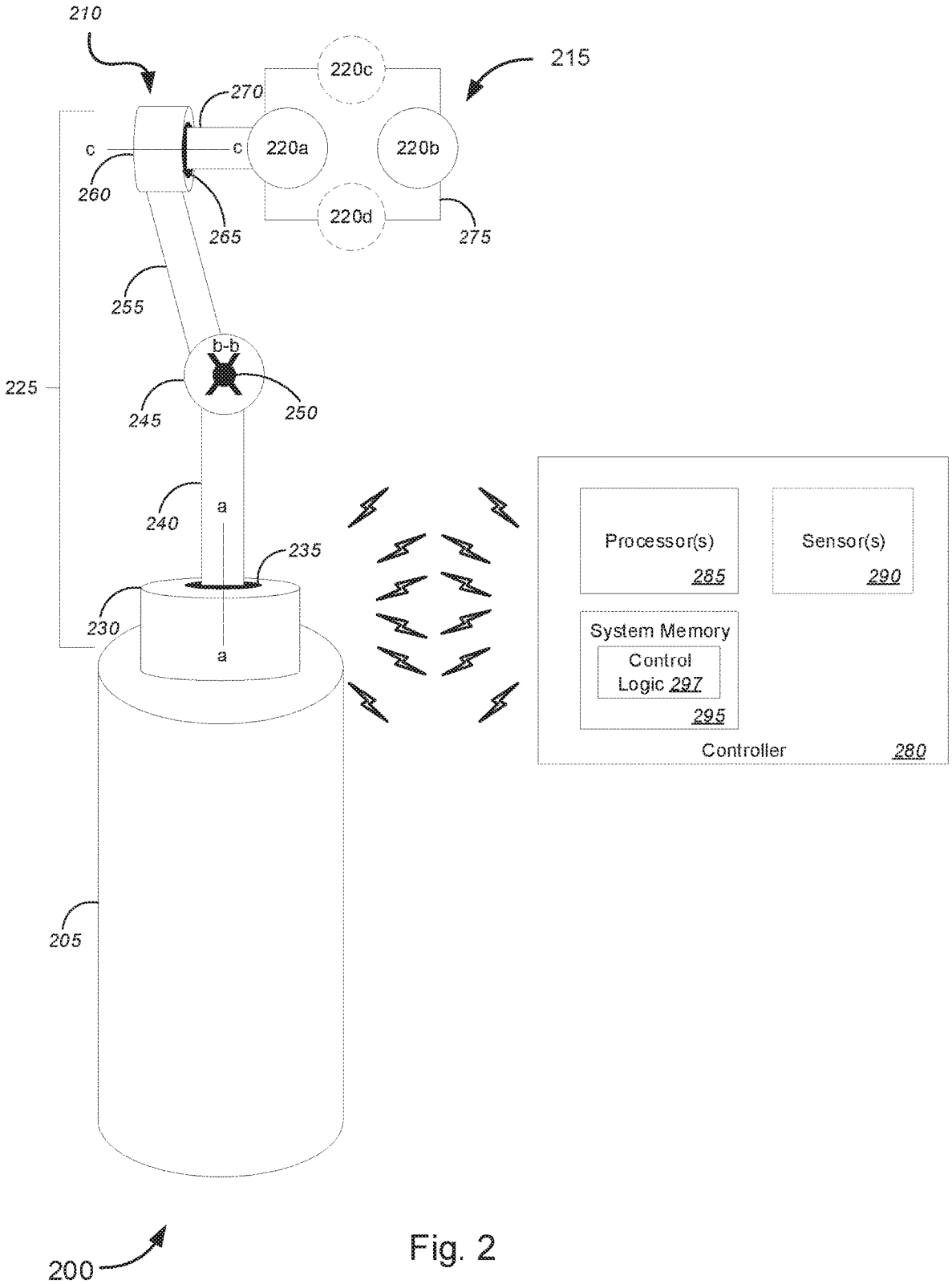
FIG. 2 is a schematic diagram illustrating a system for antenna alignment using a gimbal, in accordance with various embodiments.

FIG. 2 is a schematic diagram illustrating a system 200 for antenna alignment using a gimbal, in accordance with various embodiments. The system 200 may include a structure 205, a gimbal 210, an antenna(s) 215, and a controller 265. The antenna(s) 215 may further include antenna element(s) 220*a*-220*d* (collectively, antenna element(s) 220). The gimbal 210 may be configured to couple to the antenna(s) 215 such that a position and orientation of the antenna(s) 215 may be changed via manipulation of the gimbal 210. The gimbal 210 may further be configured to fix a position and orientation of the antenna(s) 215. For example, the gimbal 210 may be configured to maintain a fixed orientation. A fixed orientation may include, without limitation, maintaining a fixed position in three-dimensional space or maintaining a direction of transmission and reception of antenna(s) 215 (e.g., keeping the antenna(s) 215 facing a specified direction). The gimbal 210 might further be configured to maintain an orientation of the antenna(s) 215 during movement of the structure 205 and/or responsive to wind load on the antenna(s) 215 and/or antenna element(s) 220*a-d* causing movement of the antenna(s) 215 or antenna element(s) 220 themselves. For example, in some embodiments, the gimbal 210 may be configured to compensate for the movement of the antenna(s) 215 or structure 205.

The system 200 may include several similarities to system 100 described above. However, instead of the passive gimbal 110 of system 100, the gimbal 210 may be an active gimbal. In some embodiments, the active elements of the gimbal 210 might also be incorporated into the passive gimbal 110.

In various embodiments, the structure 205 of system 200 may be, without limitation, one of a utility pole, a tower, a building, a house, a tree, a wire, a cable, a support line, or other vertical, erect, and/or hanging structure. Accordingly, structure 205 might sway or otherwise move due to wind, movement of the ground underlying the structure 205, and/or expand/contract due to changes in temperature. The movement of the structure 205 may cause the antenna(s) 215 to move in three-dimensional space (e.g., positional change). In various embodiments, the movement of the antenna(s) 205, caused by movement of the structure 205, may be compensated for by adjusting the gimbal 210. In further embodiments, the orientation of the antenna(s) 215 may also be caused to change (e.g., directional change) by movement of the structure 205. The change in the orientation of the antenna(s) may similarly be compensated for by the gimbal 210. For example, the direction in which the antenna(s) 215 face may be changed by movement of the structure. Accordingly, the gimbal 210 may compensate for the directional change of the antenna(s) 215 by manipulating the yaw, pitch, and/or roll of the antenna(s) 215.

In some embodiments, the gimbal 210 may be coupled to the structure 205. The gimbal 210 may further be coupled to antenna(s) 215 via mount 275. The gimbal 210 may be configured to mount the antenna(s) 215 to the structure 205 in a manipulatable manner. The gimbal 210 may be configured to be mounted to the structure 205 such that the gimbal can be raised and lowered for alignment, repair, and/or maintenance. In a non-limiting example, the gimbal 210 may be mounted to a structure 205 such that the gimbal 210 may be translated up and down relative to the structure 205 (like a flag on a pole). The structure 205 may further include an arm to raise and lower the gimbal for maintenance. Additionally and/or alternatively, the gimbal 210 itself may be foldable at the joints (230, 245, 260) such that a technician, installer, etc. can reach the antenna(s) 215 attached to a mount 275 of the gimbal.

In various embodiments, the gimbal 210 might be configured to compensate for at least part of the movement of the structure 205. For example, the gimbal 210 may be configured to adjust a position of the antenna(s) 215 in three-dimensional space (e.g., positional change), and additionally or alternatively, maintain a fixed orientation of the antenna(s) 215 by adjusting one or more of the yaw, pitch, and/or roll of the antenna(s) 215 (e.g., directional change). In some further embodiments, the directional and positional changes may correspond to maintaining a direction of transmission and/or reception of the antenna(s) 215.

In various embodiments, the gimbal 210 may be an active gimbal configured to maintain the antenna(s) 215 in a desired position and facing a desired direction (e.g., a direction of transmission and/or reception). The gimbal 210 may include a pivoted support structure 225 with two or more orthogonal pivot axes which allow an object (such as antenna(s) 215) mounted to the gimbal 210 to be manipulated in three dimensions. In some embodiments, the gimbal 210 may be operable to allow the position and orientation of the antenna(s) 215 to remain independent of the movement of structure 205. In other words, as the structure 205 moves, the pivoted support structure 225 of the gimbal 210 may rotate around respective pivot axes to compensate for changes in the position and direction of the antenna(s) 215 caused by movement of the structure 205. This may include manipulation of the pivoted support structure 225 to maintain a position in three-dimensional space or a constant direction of transmission (and/or reception) by adjustment of the yaw, pitch, and/or roll of the antenna(s) 215.

By way of example, in some embodiments, the gimbal 210 may be an active two-axis gimbal. The pivoted support structure 225 of the active two-axis gimbal might include a first joint 230 configured to allow rotation about a first axis a-a. A first driver 235 may be coupled to the first joint 230. The first driver 235 may be configured to cause the first joint 230 to rotate about the first axis a-a. The first joint 230 and the first driver 235 might be coupled to a first member 240 at a first end. The first driver 235 may further be configured to cause the first member 240 to rotate about axis a-a.

The pivoted support structure 225 of the active two-axis gimbal may further include a second joint 245 configured to allow rotation about a second axis b-b (shown going into the page). The second joint 230 may be coupled to the first member 240 at a second end. Thus, the first joint 230 and second joint 245 may be connected via the first member 240. A second driver 250 may be coupled to the second joint 245. The second driver 250 may be configured to cause the second joint 245 to rotate about the second axis b-b. The second joint 245 and the second driver 250 may further be coupled to a second member 255 at a first end. The second driver 250 may further be configured to cause the second member 255 to rotate about axis b-b.

The first joint 230 and/or second joint 245 may include various types of suitable rotating joints, including without limitation, a ball joint, a hinge joint, or various types of bearings, such as, without limitation, ball bearings, or flexure bearings.

The active two-axis gimbal may be configured to adjust at least two of a yaw, pitch, and/or roll of the antenna(s) 215 to compensate for movement of the structure 205. Thus, the gimbal 210 may be configured to mitigate positional and/or directional changes of the antenna(s) 215 (e.g., changes in the direction the antenna(s) 215 are facing) coupled to the pivoted support structure 225, by adjusting for movement around the at least two axes.

In further embodiments, the gimbal 210 may be an active three-axis gimbal. The pivoted support structure 225 of the active three-axis gimbal might include a first joint 230 configured to allow rotation about a first axis a-a. A first driver 235 may be coupled to the first joint 230. The first driver 235 may be configured to actuate the first joint 230, causing the first joint 230 to rotate about the first axis a-a. The first joint 230 and the first driver 235 might be coupled to a first member 240 at a first end. The first driver 235 may further be configured to cause the first member 240 to rotate about axis a-a.

The pivoted support structure 225 of the active three-axis gimbal may further include a second joint 245 configured to allow rotation about a second axis b-b (shown going into the page). The second joint 245 may be coupled to the first member 240 at a second end. Thus, the first joint 230 and second joint 245 may be connected via the first member 240. A second driver 250 may be coupled to the second joint 245. The second driver 250 may be configured to actuate the second joint 245, causing the second joint 245 to rotate about the second axis b-b. The second joint 245 and the second driver 250 may further be coupled to a second member 255 at a first end. The second driver 250 may further be configured to cause the second member 255 to rotate about axis b-b.

The pivoted support structure 225 of the active three-axis gimbal may also include a third joint 260 configured to allow rotation about a third axis c-c. The third joint 260 may be coupled to the second member 255 at a second end. Thus, the second joint 245 and third joint 260 may be connected via the second member 255. A third driver 265 may be coupled to the third joint 260. The third driver 265 may be configured to actuate the third joint 260, causing the third joint 260 to rotate about the third axis c-c. The third joint 260 and the third driver 265 may further be coupled to a third member 270 at a first end. The third driver 265 may further cause the third member 270 to rotate about axis c-c.

The first joint 230, second joint 245, and/or third joint 260 may include various types of suitable rotating joints, including without limitation, a ball joint, a hinge joint, or various types of bearings, such as, without limitation, ball bearings, or flexure bearings. The active three-axis gimbal 210 may be configured to compensate for a positional change or a directional change of the antenna(s) 215. For example, the gimbal 210 may be configured to adjust for positional changes in three-dimensions of the antenna(s) 215, or a directional change of the antenna(s) 215 by adjusting a yaw, pitch, and roll of the antenna(s) 215. The antenna(s) 215 may therefore be coupled to the pivoted support structure 225 via the gimbal 210.

In further embodiments, the gimbal 210 may further include a mount 275. The mount 275 may be coupled directly to the second joint 245 and/or the second member 255 of the active two-axis gimbal (not shown in FIG. 2). Alternatively, mount 275 may be coupled directly to the third joint 260 and/or the third member 275 of the active three-axis gimbal.

Accordingly, unlike the passive gimbal 110 of FIG. 1, the active gimbal 210 may include various actuating devices, such as the first driver 235, second driver 250, and third driver 265, configured to actuate a respective joint 230, 245, 260. For example, the first driver 235, the second driver 250, and the third driver 265 might be configured to cause the first joint 230, the second joint 245, and/or the third joint 260 respectively, to rotate about the first axis a-a, the second axis b-b, and/or the third axis c-c, respectively. In various embodiments, the first, second, and third drivers 235, 250, 265 may include various types of actuators. Suitable actuators may include, without limitation, various electric motors including DC motors (e.g., a brushless DC motor) and AC motors, pneumatic actuators (and associated compressors), and hydraulic actuators (and associated motors). In various further embodiments, as will be described in greater detail below, each of the first, second, and third drivers 235, 250, 265 may be coupled to a controller, such as the controller 280, configured to control the first, second, and third drivers 235, 250, 265.

In various embodiments, the antenna(s) 215 may be coupled to the mount 275 such that movement of the antenna(s) 215 relative to the mount 275 is restricted. Thus, the gimbal 210 may be configured to manipulate the antenna(s) 215 via adjustment of the mount. In other words, as the first joint 230, the second joint 245, and/or the third joint 260 rotate about the first axis a-a, the second axis b-b, and/or the third axis c-c, respectively, the mount 275 may be manipulated to compensate for movement in three-dimensional space, and/or to compensate for changes in the orientation of the mount 275, and by extension antenna(s) 215. For example, in some embodiments, compensating for positional changes (e.g., movement in three-dimensional space) may include maintaining a substantially static position in space by rotation of one or more of the first, second, and third joints 230, 245, 260 by the first, second, and third drivers 235, 250, 265, respectively. In some embodiments, movement of the structure 205 may be compensated at least partially in three-dimensions by rotation of one or more of the first, second, and third joints 230, 245, 260 by the first, second, and third drivers 235, 250, 265, respectively. For example, if the structure 205 moves in a first direction, the gimbal 210 may compensate for this movement by adjusting the position of the mount 275 (and in turn antenna(s) 215), at least partially, in an opposite direction to the first direction. In various embodiments, compensation for positional changes may occur dynamically with the movements of the structure 205. Similarly, directional changes introduced by the movement of the structure 205 may be compensated by the gimbal 210. This may include, for example, maintaining a substantially static orientation of the mount 275, and by extension antenna(s) 215, dynamically with the movement of the structure 205. For example, if movement of the structure 205 causes a shift in the orientation of the mount 275 (and antenna(s) 215) in one or more of a yaw, pitch, or roll axes, the gimbal 210 may compensate for these changes by at least partially adjusting the yaw, pitch, or roll axes of the mount 275 in the opposite direction via the first, second, and third drivers 235, 250, 265. In some embodiments, the gimbal 210 may be configured to maintain a substantially static orientation of the mount 275, and by extension the antenna(s) 215.

In some embodiments, one or more antenna(s) 215 may be coupled to mount 275. By way of example, the antenna(s) 215 may include, without limitation, at least one of a lateral patch antenna, patch antenna array, micro-strip patch antenna, a two-dimensional ("2D") waveguide antenna, a three-dimensional ("3D") antenna array, dipole antenna, and/or a parabolic antenna. In some cases, at least one of the antenna(s) 215 might include one or more antenna element(s) 220*a-d* (collectively, antenna element(s) 220).

System 200 may further include a controller 280. The controller 280 may include a processor 285, optional sensor(s) 290, system memory 295, and control logic 297. In some embodiments, some (or all) of the controller 280 may be incorporated within structure 205 and/or the gimbal 210 (e.g., the pivoted support structure 225, mount 275). In other embodiments, the controller 280 may be a standalone device, physically decoupled from the gimbal 210 and structure 205. While certain components of an exemplary controller 280 are illustrated functionally by FIG. 2, the controller 280 may include one or more components of a general purpose computer system, as described below with respect to FIG. 5.

Controller 280 may be communicatively coupled (via a wired and/or wireless connection) to drivers 235, 250, and/or 265 of the gimbal 210. The controller 280 might receive input from the one or more sensors 290 indicative of the position and orientation of the mount 275, the antenna(s) 215, and/or the antenna element(s) 220. Based on input from the one or more sensor(s) 290, the controller 280 may be configured to cause at least one of the first driver 235, the second driver 250, and/or the third driver 265 to rotate at least one of the first joint 230, the second joint 245, and/or the third joint 260. Thus, in various embodiments, the controller 280 may cause at least one of the first driver 235, the second driver 250, and/or the third driver 265 to cause the mount 275, antenna(s) 215, and/or antenna element(s) 220 to move to compensate for any changes in the position and orientation of the antenna(s) 215 caused by the movement of the structure 205 and/or wind load on antenna(s) 215. In other words, the movement of the antenna(s) 215 (e.g., positional change, directional change), caused by movement of the structure 205 and/or wind load on antennas 215, may be compensated for by actuation of the drivers 235, 250, 265 of gimbal 210. In some embodiments, the controller 280 may be configured to compensate for movement of the structure 205 in substantially real-time, based on input from the one or more sensors 290.

In various embodiments, the controller 280 may be communicatively coupled (via a wired and/or wireless connection) to one or more sensor(s) 290. Sensor(s) 290 may include, without limitation, one or more positional sensors, one or more temperature sensors, one or more accelerometers, one or more gyroscopes, one or more magnetometers (e.g., compass), one or more global positioning systems, one or more cameras, one or more vibration sensors, one or more wind sensors, one or more seismic sensors, and/or one or more signal sensors. The sensors 290 may be incorporated into, without limitation, at least one of the structure 205, the gimbal 210, the antenna(s) 215, the antenna element(s) 220, the mount 275, and/or the controller 280. Sensor(s) 290 may be configured to detect and send information to the controller 280 about the state of the gimbal 210, and/or the position or orientation (e.g., direction) of the one or more antenna(s) 215, antenna element(s) 220, and/or mount 275. In some embodiments, the state of the gimbal 210 may include, without limitation, an angular position of each of the drivers 235, 250, 265, and the position of the gimbal 210 in three-dimensions. Additionally and/or alternatively, the one or more sensor(s) 290 may detect and send information to the controller 280 about the movement of the structure 205 and/or wind load on the antenna(s) 215 and/or antenna element(s) 205. For example, in some embodiments, the controller 280 may detect movement of the structure 205 and/or the position of the structure 205 based on input from a camera, gyroscope, accelerometers, or any combination of the one or more sensor(s) 290.

Controller 280 may receive input from sensor(s) 290 indicative of the orientation of at least one of the mount 275, the antenna(s) 215, and/or the antenna element(s) 220. Additionally, and/or alternatively, controller 280 may receive input from senor(s) 290 indicative of the movement of the structure 205. Based on a determination that the orientation of at least one of the mount 275, the antenna(s) 215, and/or the antenna element(s) 220 is changing due to movement of the structure 205, the controller 280 may direct at least one of the first driver 235, the second driver 250, and/or the third driver 265 to move to compensate for the changing orientation of at least one of the mount 275, the antenna(s) 215, and/or the antenna element(s) 220. For example, if the structure 205 moves in a first direction, the controller 280 may cause the gimbal 210 to compensate for this movement through drivers 235, 250, and 265 by adjusting the position of the mount 275 (and in turn antenna(s) 215), at least partially, in an opposite direction to the first direction.

Similarly, positional and/or directional changes introduced by wind load on mount 275, antenna(s) 215, and/or antenna element(s) 220 may be compensated for by the controller 280 by causing the gimbal 210 to compensate for this movement through drivers 235, 250, and 265. Controller 280 may receive input from sensor(s) 290 about the orientation of at least one of the mount 275, the antenna(s) 215, and/or the antenna element(s) 220. Additionally and/or alternatively, controller 280 may receive input from senor(s) 290 about the wind load on mount 275, the antenna(s) 215, and/or the antenna element(s) 220. Based on a determination that at least one of the mount 275, the antenna(s) 215, and/or the antenna element(s) 220 is experiencing wind load and the orientation of the mount 275, the antenna(s) 215, and/or the antenna element(s) 220 is changing due to wind load, the controller 280 may direct at least one of the first driver 235, the second driver 250, and/or the third driver 265 to compensate for the changing orientation of at least one of the mount 275, the antenna(s) 215, and/or the antenna element(s) 220. For example, if the wind load causes the mount 275, the antenna(s) 215, and/or the antenna element(s) 220 to move in a first direction, the controller 280 may cause the gimbal 210 to compensate for this movement through drivers 235, 250, and 265 by adjusting the position of the mount 275 (and in turn antenna(s) 215), at least partially, in an opposite direction to the first direction.

In various embodiments, controller 280 might include control logic 297. Control logic 297 might be encoded and/or stored on a non-transitory computer readable storage medium, such as system memory 295. Control logic 297 may include various non-transitory computer readable media executable by, for example, a processor 285 of the controller 280. The control logic 297 may include a plurality of computer readable instructions configured to be executable by the processor 285 to perform the various functions described above. For example, if the movement of the structure 205 or the wind load causes the mount 275, the antenna(s) 215, and/or the antenna element(s) 220 to move in a first direction, the control logic may include instructions that, when executed by the processor 285, cause the gimbal 210 to compensate for this movement through drivers 235, 250, and 265 by adjusting the position of the mount 275 (and in turn antenna(s) 215), at least partially, in an opposite direction to the first direction.

Additionally, and/or alternatively, system 200 may compensate for wind load using a method similar to the passive gimbal system 100. To address the effects of wind load on the position or orientation of the antenna(s) 215, antenna element(s) 220, and/or mount 275, at least two antenna(s) 215 and/or at least two antenna element(s) 220 may be coupled to the mount 275, such that a wind load on one or more antenna(s) 215 or one or more antenna element(s) 220 is offset by the one or more of the other antenna(s) 215 or antenna element(s) 220. Additionally and/or alternatively, a counterbalance may be used to offset wind load on an antenna 115 and/or antenna element 120. The counterbalance may include, but is not limited to, an antenna, an antenna element, a weight, a dummy element, a stabilizer, or other counterbalance. For example, the at least two antenna(s) 215, antenna element(s) 220, at least one antenna 115 and at least one counterbalance, and/or at least one antenna element 120 and at least one counterbalance may be mounted such that the antenna(s) 215, antenna element(s) 220, at least one antenna 115 and at least one counterbalance, and/or at least one antenna element 120 and at least one counterbalance offset wind load about a center of the mount 275. In some embodiments, the at least two antenna(s) 215, antenna element(s) 220, at least one antenna 115 and at least one counterbalance, and/or at least one antenna element 120 and at least one counterbalance may be disposed equidistant from a center 275. Although offsetting wind load is described below with respect to antenna element(s) 220, similar techniques may be applied to one or more antenna(s) 215 or antenna arrays.

One way to offset wind load, is to provide a first antenna element 220*a* and a second antenna element 220*b* on opposite sides of the mount 275. The first antenna element 220*a* and the second antenna element 220*b* may be substantially equidistant from a center of the mount 275. Antenna elements 220*a* and 220*b* may be identical (e.g., identical in at least one of size, shape, and/or weight). By providing identical antenna elements on opposite sides of the mount 275 substantially equidistant from a center of the mount 275, the wind load on antenna element 220*a* may be offset by the wind load on antenna element 220*b* and the antenna element(s) 220*a* and 220*b* are able to maintain a constant direction of transmission (and/or reception).

In some embodiments, in addition to elements 220*a* and 220*b*, or alternatively, a third antenna element 220*c* and a fourth antenna element 220*d* may be provided on opposite sides of the mount 275. The third antenna element 220*c* and the fourth antenna element 220*d* may be substantially equidistant from a center of the mount 275, the third antenna element 220*c* located above the center of the mount 275 and the fourth antenna element 220*d* located below the center of the mount. In some embodiments, antenna elements 220*c* and 220*d* may be identical (e.g., identical in at least one of size, shape, and/or weight). By providing identical antenna elements on opposite sides of the mount 275 substantially equidistant from a center of the mount 275, the wind load exerted on antenna element 220*c* may be offset by the wind load exerted on antenna element 220*d*, such that movement of the antenna(s) 215 in one of a yaw, pitch, or roll axes are mitigated. Thus, the active control of the gimbal 210, via the controller 280, may be implemented in combination with the arrangement of the one or more antenna element(s) 220 as described above.

In additional embodiments, an antenna element 220*a* and a counterbalance may be provided on opposite sides of the mount 275. The counterbalance may be substituted for antenna element 220*b*. The first antenna element 220*a* and the counterbalance may be substantially equidistant from a center of the mount 275. The first antenna element 220*a* and the counterbalance may be identical (e.g., identical in at least one of size, shape, and/or weight). By providing an antenna element 220*a* and a counterbalance on opposite sides of the mount 275 substantially equidistant from a center of the mount 275, the wind load on antenna element 220*a* may be offset by the wind load on the counterbalance and the antenna element 220*a* may be able to maintain a constant direction of transmission (and/or reception).

It is to be understood that the examples provided herein are not to be taken as limiting. For example, the above examples should not be taken as limiting the number of antenna(s) 215, antenna element(s) 220, and/or counterbalances that may be placed on the mount 275. In other examples, two or more antenna(s) 215, antenna elements 220, and/or counterbalances may be placed in the center of the mount 275 to offset the wind load about a center of the mount 275, including odd numbers of antenna(s) 215 antenna element(s) 220, and/or counterbalances.

In some embodiments, the controller 280 may be configured to orient at least one of the mount 275, the antenna(s) 215, and/or the antenna element(s) 220 based on a signal quality (e.g., signal strength, noise, etc.) of a received transmission. Sensor(s) 290 may be used to determine a signal quality corresponding to a plurality of orientations (e.g., positions and/or directions). The controller 280 may then determine one orientation (which may include a position and direction) from among a plurality of orientations where the signal quality is the optimized (e.g., where the signal strength is greatest, where there is the least amount of noise, etc.). Based on a determination of the orientation where the signal quality is optimized, the controller 280 may direct at least one of the first driver 235, the second driver 250, and/or the third driver 265 to move to cause the antenna(s) 215, the antenna element(s) 220, and/or the mount 275 to move toward the position/orientation where the signal quality is optimized.

These and other functions of the system 200 (and its components) are described in greater detail below with respect to FIGS. 3-5.

Figure 3:
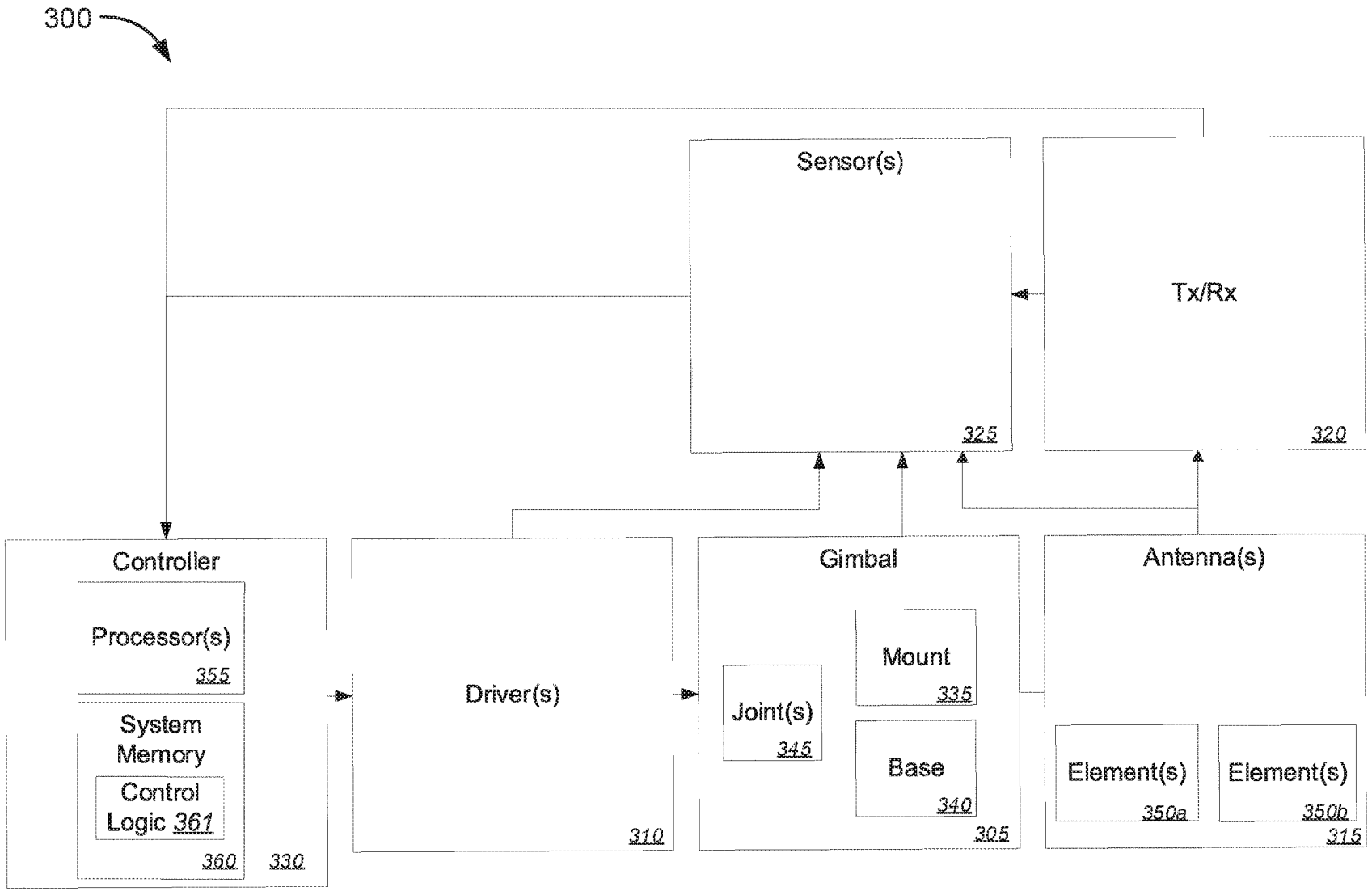
FIG. 3 is a functional block diagram illustrating a system for antenna alignment using a gimbal, in accordance with various embodiments.

FIG. 3 is a functional block diagram illustrating a system for antenna alignment using a gimbal, in accordance with various embodiments. The system 300 may include a gimbal 305 (which might correspond to gimbal 110 of FIG. 1 and/or gimbal 210 of FIG. 2), driver(s) 310, antenna(s) 315 comprising one or more antenna element(s) 350 and at least one of a transmitter, a receiver, and/or transceiver (collectively, Tx/Rx 320), a sensor(s) 325, and/or a controller 330.

The gimbal 305 may be at least one of an active two-axis gimbal or an active three-axis gimbal. The gimbal 305 may include a mount 335 which may be coupled to antenna(s) 315 and/or antenna element(s) 350. The gimbal 305 may further include a base 340. The base 340 of the gimbal 305 may be coupled to a structure which might include, without limitation, one of a utility pole, a tower, a building, a house, a tree, a wire, a cable, a support line, or other vertical, erect, and/or hanging structure. In various embodiments, the gimbal 305 might be configured to compensate for at least part of the movement of the structure. For example, the gimbal 305 may be configured to adjust a position of the antenna(s) 315 in three-dimensional space (e.g., positional change), and additionally or alternatively, maintain a fixed orientation of the antenna(s) 315 by adjusting one or more of the yaw, pitch, and/or roll of the antenna(s) 315 (e.g., directional change). In some further embodiments, the directional and positional changes may correspond to maintaining a direction of transmission and/or reception of the antenna(s) 315.

The gimbal 305 may further include one or more joint(s) 345 and/or one or more driver(s) 310. The one or more driver(s) 310 may be coupled to the one or more joint(s) 345. The driver(s) 310 may be configured to cause the joint(s) 345 to rotate about a rotation axis to compensate for movement of the structure. Additionally, the driver(s) 310 may be configured to cause the joint(s) 345 to rotate about a rotation axis to maintain a fixed orientation and/or position of mount 335, antenna(s) 315, and/or antenna element(s) 350, as previously discussed.

The antenna(s) 315 may have one or more antenna element(s) 350. Additionally, and/or alternatively, the antenna(s) 315 and/or antenna element(s) 350 may be configured to be a transmitter, a receiver, and/or transceiver (collectively, Tx/Rx 320). Thus, Tx/Rx 320 may include both transmitted signals and received signals. In some embodiments, Tx/Rx 320 may further be coupled to sensor(s) 325, which may be configured to determine a signal quality (e.g., signal strength, noise, etc.) of incoming signals. The Tx/Rx 320 may further be communicatively coupled (via a wired and/or wireless connection) to the controller 330. For example, in some embodiments, the Tx/Rx 320 may be configured to determine a signal quality of a received signal. Accordingly, the Tx/Rx 320 may transmit information associated with a signal quality to the one or more sensors 325 and/or to controller 330. In yet further embodiments, the one or more sensor(s) 325 may include a receiver in communication with the antenna(s). For example, the one or more sensor(s) 325 may include a wireless device in communication with the antenna(s) 315. Accordingly, in some embodiments, the sensor(s) 325, in this case including a wireless device, may be configured to indicate a signal quality of a transmitted signal form the antenna(s) 315 to the controller 330.

Thus, in various embodiments, the sensor(s) 325 may include, without limitation, one or more positional sensors, one or more temperature sensors, one or more accelerometers, one or more gyroscopes, one or more magnetometers, one or more global positioning systems, one or more cameras, one or more vibration sensors, one or more wind sensors, one or more seismic sensors, and/or one or more signal sensors. Sensor(s) 325 may be incorporated within gimbal 305, driver(s) 310, antenna(s) 315, Tx/Rx 320, controller 330, and/or antenna element(s) 350.

Sensor(s) 325 may be configured to send information to controller 330 via a wired and/or wireless connection. This information may include, without limitation, information associated with a state (e.g., position, orientation, direction, etc.) of the gimbal 305, driver(s) 310, antenna(s) 315, mount 335, and/or antenna element(s) 350, information associated with movement of the structure, information associated with wind load on the antenna(s) 315, mount 335, and/or antenna element(s) 350, and/or information associated with a signal quality of a received or transmitted signal.

In various embodiments, the controller 330 may include a processor(s) 355 and a system memory 360 with control logic 361. The controller 330 may be communicatively coupled (via a wired and/or wireless connection) to the one or more driver(s) 310, one or more sensor(s) 325, and/or Tx/Rx 320. Based on information received from Tx/Rx 320 and/or sensor(s) 325, the controller 330 may cause the one or more driver(s) 310 to move and cause the joints 345 of the gimbal 305 to rotate to a target orientation (e.g., target position and/or direction). For example, the controller 330 may be configured to cause drivers 310 to adjust a position of the antenna(s) 315 in three-dimensional space (e.g., positional change), and additionally or alternatively, maintain a fixed orientation of the antenna(s) 315 by adjusting one or more of the yaw, pitch, and/or roll of the antenna(s) 315 (e.g., directional change).

As previously described, in various embodiments, the controller 330 may be configured to control a state of the gimbal 305 to compensate for movement of a structure and/or wind load on mount 335, antenna(s) 315, and/or antenna element(s) 350. As previously described, the state of the gimbal may correspond to the state of the various drivers 310 of the gimbal 305 (e.g., angular position of the drivers 310), or a position or orientation of the mount 335, the antenna(s) 315, and/or the antenna element(s) 350. Thus, the controller 330 may be configured to fix a position and orientation of the mount 335, antenna(s) 315, and/or antenna element(s) 350 by controlling a state of the gimbal 305. In various embodiments, a target position and target orientation of the mount 335, the antenna(s) 315, and/or the antenna element(s) 350 may be determined by user input. Thus, in various embodiments, the controller 330 may be configured to receive an input indicative of a target position and target orientation of the mount 335, the antenna(s) 315, and/or the antenna element(s) 350. A state of the gimbal 305 associated with the target position and target orientation may also be determined by the controller 330. As movement of the mount 335, antenna(s) 315, and/or antenna element(s) 350 occurs, the controller 330 may be configured to mitigate, or in some cases altogether offset, changes from the target position and target orientation.

Additionally, and/or alternatively, the target position and target orientation may correspond to a position and orientation of the mount 335, antenna(s) 315, and/or antenna element(s) 350 where signal quality (e.g., signal strength, noise, etc.) of a transmitted and/or received signal (e.g., Tx/Rx 320) is optimized (e.g., where the signal strength is greatest, where there is the least amount of noise, etc.). In some embodiments, this may be an automated process in which the controller 330 may be configured to control the gimbal 305 to find an optimal signal quality for Tx/Rx 320 operation. Thus, the target position and target orientation may be determined where the optimal signal quality is found. The state of the gimbal 305 may also be determined by the controller at the target position and target orientation. Thus, in various embodiments, the controller 330 may be configured to cause the drivers 310 to move the mount 335, antenna(s) 315, and/or antenna element(s) 350 to mitigate, or in some cases altogether offset, changes from the target position and target orientation. In various embodiments, to determine an orientation where a signal quality is optimized, the controller 330 may receive input from the Tx/Rx 320 and/or one or more sensors 325 indicating a signal quality corresponding to a plurality of states of the gimbal. The controller 330 may then be configured to determine, based on the input received from the sensor(s) 325, a state of the gimbal where the signal quality is optimized.

In various embodiments, once the target position and target orientation are determined by the controller 330, the controller 330 may then determine, based on input from the gimbal 305, driver(s) 310, or one or more sensors 325, a current state of the gimbal 305 corresponding to the target position and target orientation. Then, as movement occurs in the structure or due to wind loads, the controller 330 may receive, in real-time, from the sensor(s) 325 information associated with the position and orientation of the mount 335, the antenna(s) 315, and/or the antenna element(s) 350, or in some embodiments, the structure to which the gimbal 305 is attached. Based on the information received from the sensor(s) 330, the controller 330 may further determine whether the actual position and actual orientation of the mount 335, antenna(s) 315, and/or antenna element(s) 350 deviates from the target position and target orientation. Based on a determination that the target position and target orientation of the mount 335, antenna(s) 315, and/or antenna element(s) 350 and the actual orientation of the mount 335, antenna(s) 315, and/or antenna element(s) 350 deviate, the controller 330 may be configured to actuate at least one driver(s) 310, thereby, rotating at least one of the joint(s) 345 to mitigate the deviation and return, at least in part, to the target position and target orientation. Thus, the state of the gimbal 305 may be adjusted, in turn causing movement of the gimbal 305, to compensate for the movement of a structure and/or mount 335, antenna(s) 315, and/or antenna element(s) 350. In further embodiments, the gimbal 305 may be configured to direct antenna(s) 315, Tx/Rx 320, and/or antenna element(s) 350 to a position and orientation where signal quality is optimized at any point in time. In various embodiments, the above described adjustments to the gimbal 305 by the controller 330 may occur in real-time, continuously, periodically, or upon request.

In various embodiments, controller 330 might include control logic 361. Control logic 361 might be encoded and/or stored on a non-transitory computer readable storage medium, such as system memory 360. Control logic 361 may include various non-transitory computer readable media executable by, for example, a processor 355 of the controller 330. The control logic 361 may include a plurality of computer readable instructions configured to be executable by the processor 355 to perform the various functions described above. For example, if the movement of a structure or the wind load causes the mount 335, the antenna(s) 315, and/or the antenna element(s) 350 to move in a first direction, the control logic 361 may include instructions that, when executed by the processor 355, cause the gimbal 305 to compensate for this movement through driver(s) 310 by adjusting the position of the mount 335 (and in turn antenna(s) 315), at least partially, in an opposite direction to the first direction.

Figure 4:
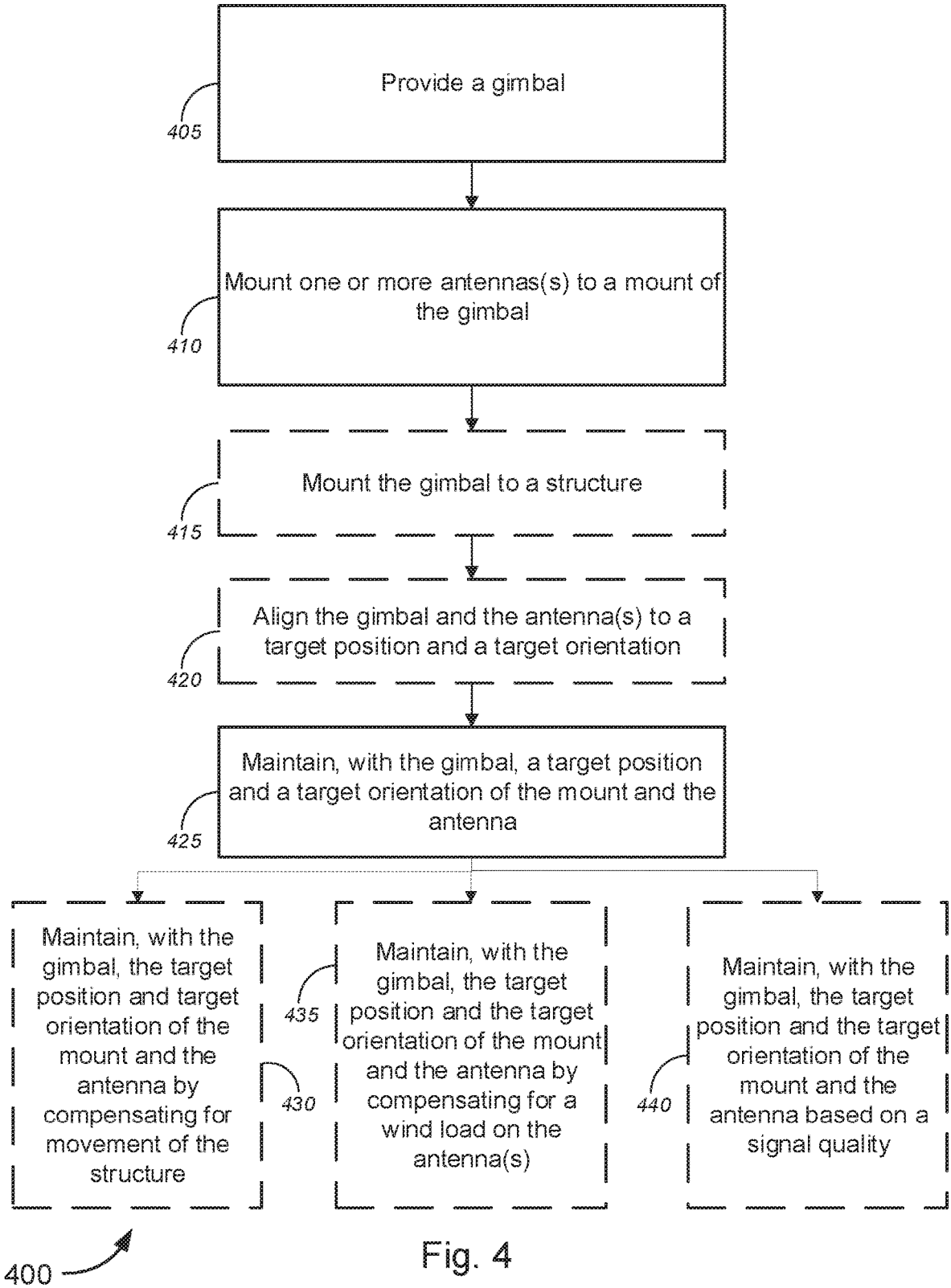
FIG. 4 is a flow diagram illustrating a method for implementing antenna alignment using a gimbal, in accordance with various embodiments.

FIG. 4 is a flow diagram illustrating a method 400 for implementing antenna alignment using a gimbal, in accordance with various embodiments.

While the techniques and procedures are depicted and/or described in a certain order for purposes of illustration, it should be appreciated that certain procedures may be reordered and/or omitted within the scope of various embodiments. Moreover, while the method 400 illustrated by FIG. 4 can be implemented by or with (and, in some cases, are described below with respect to) the systems, apparatuses, or embodiments 100, 200, and 300 of FIGS. 1, 2, and 3, respectively (or components thereof), such methods may also be implemented using any suitable hardware (or software) implementation. Similarly, while each of the systems, apparatuses, or embodiments 100, 200, and 300 of FIGS. 1, 2, and 3, respectively (or components thereof), can operate according to the method 400 illustrated by FIG. 4 (e.g., by executing instructions embodied on a computer readable medium), the systems, apparatuses, or embodiments 100, 200, and 300 of FIGS. 1, 2, and 3, respectively, can each also operate according to other modes of operation and/or perform other suitable procedures.

The method 400 may begin, at block 405, by providing a gimbal (block 405). In some embodiments, the gimbal may include passive two-axis or passive three-axis gimbals (as described with respect to FIG. 1). In further embodiments, the gimbal may include active two-axis and/or active three-axis gimbals (described with respect to FIG. 2 and FIG. 3).

At block 410, the method 400 continues with coupling one or more antenna(s) to a mount of the gimbal. Merely by way of example, the antenna(s) may include, without limitation, at least one of a lateral patch antenna, patch antenna array, micro-strip patch antenna, a two-dimensional ("2D") waveguide antenna, a three-dimensional ("3D") antenna array, dipole antenna, and/or a parabolic antenna. In some cases, at least one of the antenna(s) might include one or more antenna element(s).

The method 400, at block 415, may further include mounting the gimbal to a structure. The structure may include, without limitation, one of a utility pole, a tower, a building, a house, a tree, a wire, a cable, a support line, or other vertical, erect, and/or hanging structure. Accordingly, the structure might sway or otherwise move due to wind, movement of the ground underlying the structure, and/or expand/contract due to changes in temperature. The gimbal 210 may be mounted to the structure 205 such that the gimbal can be raised and lowered for alignment, repair, and/or maintenance. In a non-limiting example, the gimbal may be mounted to a structure such that it may be translated up and down relative to the structure (like a flag on a pole). Additionally and/or alternatively, the gimbal itself may be foldable at the joints such that a technician, installer, etc. can reach the antenna(s) attached to a mount of the gimbal.

The method 400 may optionally include, at block 420, aligning the gimbal and antennas to a target position and target orientation. In various embodiments, the initial target position and orientation may be determined by user input. In other words, a user may set the initial target position and orientation of the gimbal. In other embodiments, an initial target position and orientation may be determined using a signal quality. The target position and orientation may correspond to a position and orientation where the signal quality optimized.

Method 400 may continue, at block 425, by maintaining, with the gimbal, at least one of a target position or a target orientation of the antenna. In some embodiments, method 400 may include, at block 430, maintaining, with the gimbal, the at least one of the target position or target orientation of the mount or the antenna by compensating for movement of the structure. For example, the gimbal may be configured to adjust a position of the antenna(s) in three-dimensional space (e.g., positional change) and maintain a fixed orientation of the antenna(s) by adjusting one or more of the yaw, pitch, and/or roll of the antenna(s) (e.g., directional change), as previously described. In some further embodiments, the directional and positional changes may correspond to maintaining a direction of transmission and/or reception of the antenna(s).

In some embodiments, in addition to and/or alternative to maintaining the target orientation of the mount by compensating for movement of a structure, method 400 may further include, at block 435, maintaining, with the gimbal, the target position or the target orientation of the mount of the antenna by compensating for a wind load on the antenna(s).

As previously described, to counteract a wind load acting upon an antenna, at least two antenna elements might be provided on the passive two-axis gimbal system, the active two-axis gimbal system, the passive three-axis gimbal system, and/or the active three-axis gimbal system. The at least two antenna elements might be coupled to the mount and each antenna element may be disposed on opposite sides of the mount substantially equidistant from a center of the mounting bracket. By symmetrically spacing the antenna elements on either side of the mount, the wind load experienced by the first antenna element may offset (cancel out) the wind load experienced by the second antenna element. The antenna elements may be identical in at least one of size, shape, and/or weight.

In additional embodiments, method 400, at block 440, may include maintaining, with the gimbal, the target position and the target orientation of the mount based on a signal quality (e.g., signal strength, noise, etc.). This may be done via an active two-axis gimbal and/or an active three-axis gimbal. In some embodiments, one or more sensors may be attached to the structure, gimbal, driver(s), mount, and/or antenna(s) to determine a signal quality from various positions and orientations. As previously described, the one or more sensor(s) may send information to a controller via a wired and/or wireless connection. This information may include, without limitation, information associated with a position and orientation of driver(s), mount, and/or antenna(s), a state of the gimbal, and/or information indicative of the signal quality.

Exemplary System and Hardware Implementation

Figure 5:
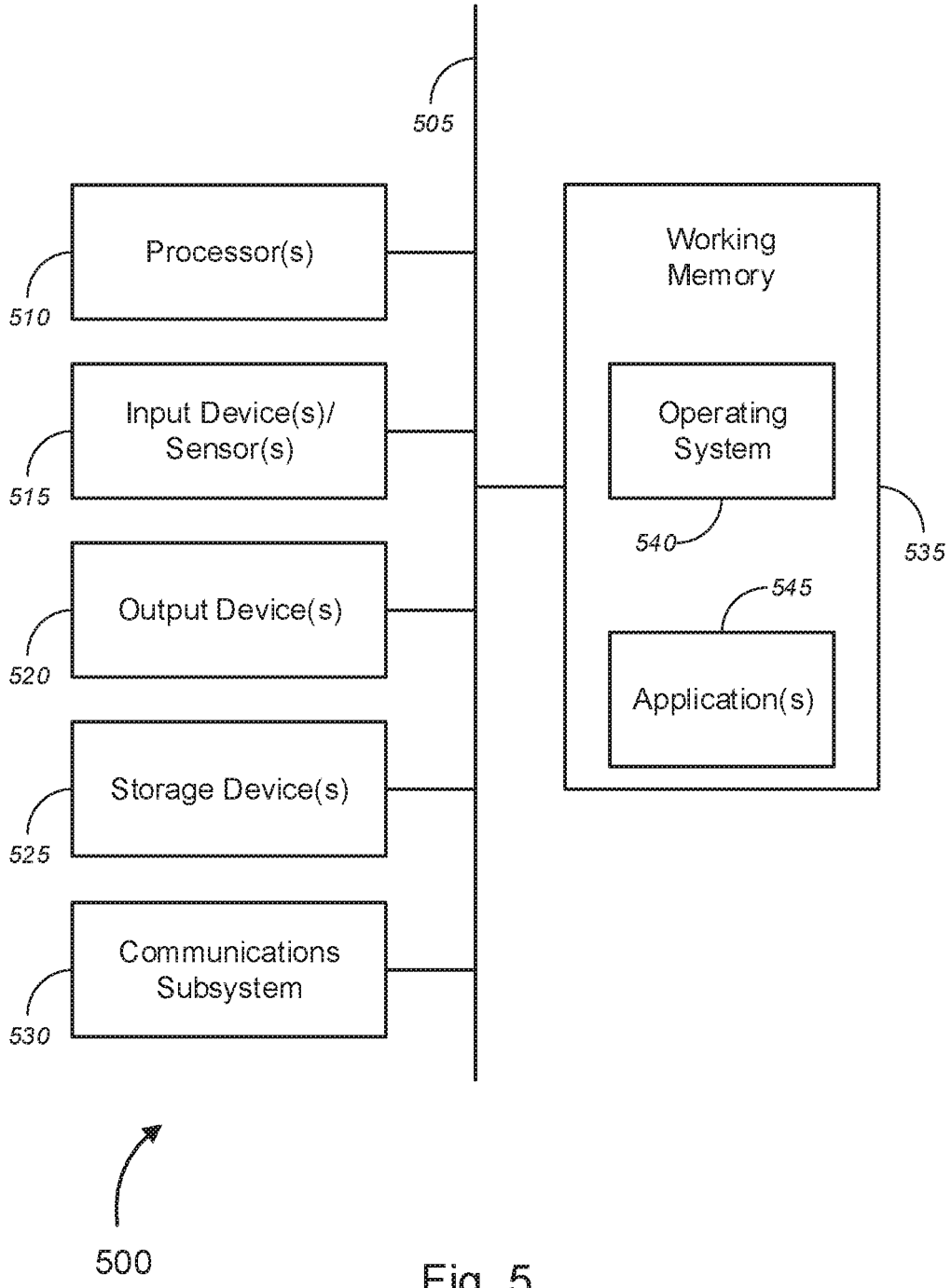
FIG. 5 is a block diagram illustrating an exemplary computer or system hardware architecture, in accordance with various embodiments.

FIG. 5 is a block diagram illustrating an exemplary computer or system hardware architecture, in accordance with various embodiments. FIG. 5 provides a schematic illustration of one embodiment of a computer system 500 of the service provider system hardware that can perform the methods provided by various other embodiments, as described herein, and/or can perform the functions of computer or hardware system (i.e., gimbal systems 210 and 305, controller(s) 280 and 330, sensor(s) 290 and 325, etc.), as described above. It should be noted that FIG. 5 is meant only to provide a generalized illustration of various components, of which one or more (or none) of each may be utilized as appropriate. FIG. 5, therefore, broadly illustrates how individual system elements may be implemented in a relatively separated or relatively more integrated manner.

The computer or hardware system 500—which might represent an embodiment of the computer or hardware system (i.e., gimbal systems 210 and 305, controller(s) 280 and 330, sensor(s) 290 and 325, etc.), described above with respect to FIGS. 1-4—is shown comprising hardware elements that can be electrically coupled via a bus 505 (or may otherwise be in communication, as appropriate). The hardware elements may include one or more processors 510, including, without limitation, one or more general-purpose processors and/or one or more special-purpose processors (such as microprocessors, digital signal processing chips, graphics acceleration processors, and/or the like); one or more input devices/sensor(s) 515, which can include, without limitation, a mouse, a keyboard, one or more temperature sensors, one or more accelerometers, one or more gyroscopes, one or more position sensors, one or more compasses, one or more global positioning systems, one or more vibration sensors, one or more wind sensors, one or more seismic sensors, one or more signal sensors and/or the like; and one or more output devices 520, which can include, without limitation, a display device, a printer, and/or the like.

The computer or hardware system 500 may further include (and/or be in communication with) one or more storage devices 525, which can comprise, without limitation, local and/or network accessible storage, and/or can include, without limitation, a disk drive, a drive array, an optical storage device, solid-state storage device such as a random access memory ("RAM") and/or a read-only memory ("ROM"), which can be programmable, flash-updateable and/or the like. Such storage devices may be configured to implement any appropriate data stores, including, without limitation, various file systems, database structures, and/or the like.

The computer or hardware system 500 might also include a communications subsystem 530, which can include, without limitation, a modem, a network card (wireless or wired), an infra-red communication device, a wireless communication device and/or chipset (such as a Bluetooth™ device, an 802.11 device, a WiFi device, a WiMax device, a WWAN device, cellular communication facilities, etc.), and/or the like. The communications subsystem 530 may permit data to be exchanged with a network (such as the network described below, to name one example), with other computer or hardware systems, and/or with any other devices described herein. In many embodiments, the computer or hardware system 500 will further comprise a working memory 535, which can include a RAM or ROM device, as described above.

The computer or hardware system 500 also may comprise software elements, shown as being currently located within the working memory 535, including an operating system 540, device drivers, executable libraries, and/or other code, such as one or more application programs 545, which may comprise computer programs provided by various embodiments (including, without limitation, hypervisors, VMs, and the like), and/or may be designed to implement methods, and/or configure systems, provided by other embodiments, as described herein. Merely by way of example, one or more procedures described with respect to the method(s) discussed above might be implemented as code and/or instructions executable by a computer (and/or a processor within a computer); in an aspect, then, such code and/or instructions can be used to configure and/or adapt a general purpose computer (or other device) to perform one or more operations in accordance with the described methods.

A set of these instructions and/or code might be encoded and/or stored on a non-transitory computer readable storage medium, such as the storage device(s) 525 described above. In some cases, the storage medium might be incorporated within a computer system, such as the system 500. In other embodiments, the storage medium might be separate from a computer system (i.e., a removable medium, such as a compact disc, etc.), and/or provided in an installation package, such that the storage medium can be used to program, configure and/or adapt a general purpose computer with the instructions/code stored thereon. These instructions might take the form of executable code, which is executable by the computer or hardware system 500 and/or might take the form of source and/or installable code, which, upon compilation and/or installation on the computer or hardware system 500 (e.g., using any of a variety of generally available compilers, installation programs, compression/decompression utilities, etc.) then takes the form of executable code.

It will be apparent to those skilled in the art that substantial variations may be made in accordance with specific requirements. For example, customized hardware (such as programmable logic controllers, field-programmable gate arrays, application-specific integrated circuits, and/or the like) might also be used, and/or particular elements might be implemented in hardware, software (including portable software, such as applets, etc.), or both. Further, connection to other computing devices such as network input/output devices may be employed.

As mentioned above, in one aspect, some embodiments may employ a computer or hardware system (such as the computer or hardware system 500) to perform methods in accordance with various embodiments of the invention. According to a set of embodiments, some or all of the procedures of such methods are performed by the computer or hardware system 500 in response to processor 510 executing one or more sequences of one or more instructions (which might be incorporated into the operating system 540 and/or other code, such as an application program 545) contained in the working memory 535. Such instructions may be read into the working memory 535 from another computer readable medium, such as one or more of the storage device(s) 525. Merely by way of example, execution of the sequences of instructions contained in the working memory 535 might cause the processor(s) 510 to perform one or more procedures of the methods described herein.

The terms "machine readable medium" and "computer readable medium," as used herein, refer to any medium that participates in providing data that causes a machine to operate in a specific fashion. In an embodiment implemented using the computer or hardware system 500, various computer readable media might be involved in providing instructions/code to processor(s) 510 for execution and/or might be used to store and/or carry such instructions/code (e.g., as signals). In many implementations, a computer readable medium is a non-transitory, physical, and/or tangible storage medium. In some embodiments, a computer readable medium may take many forms, including, but not limited to, non-volatile media, volatile media, or the like. Non-volatile media includes, for example, optical and/or magnetic disks, such as the storage device(s) 525. Volatile media includes, without limitation, dynamic memory, such as the working memory 535. In some alternative embodiments, a computer readable medium may take the form of transmission media, which includes, without limitation, coaxial cables, copper wire and fiber optics, including the wires that comprise the bus 505, as well as the various components of the communication subsystem 530 (and/or the media by which the communications subsystem 530 provides communication with other devices). In an alternative set of embodiments, transmission media can also take the form of waves (including without limitation radio, acoustic and/or light waves, such as those generated during radio-wave and infra-red data communications).

Common forms of physical and/or tangible computer readable media include, for example, a floppy disk, a flexible disk, a hard disk, magnetic tape, or any other magnetic medium, a CD-ROM, any other optical medium, punch cards, paper tape, any other physical medium with patterns of holes, a RAM, a PROM, and EPROM, a FLASH-EPROM, any other memory chip or cartridge, a carrier wave as described hereinafter, or any other medium from which a computer can read instructions and/or code.

Various forms of computer readable media may be involved in carrying one or more sequences of one or more instructions to the processor(s) 510 for execution. Merely by way of example, the instructions may initially be carried on a magnetic disk and/or optical disc of a remote computer. A remote computer might load the instructions into its dynamic memory and send the instructions as signals over a transmission medium to be received and/or executed by the computer or hardware system 500. These signals, which might be in the form of electromagnetic signals, acoustic signals, optical signals, and/or the like, are all examples of carrier waves on which instructions can be encoded, in accordance with various embodiments of the invention.

The communications subsystem 530 (and/or components thereof) generally will receive the signals, and the bus 505 then might carry the signals (and/or the data, instructions, etc. carried by the signals) to the working memory 535, from which the processor(s) 505 retrieves and executes the instructions. The instructions received by the working memory 535 may optionally be stored on a storage device 525 either before or after execution by the processor(s) 510.

These and other functions of the system 500 (and its components) are described in greater detail above with respect to FIGS. 1-4.

While certain features and aspects have been described with respect to exemplary embodiments, one skilled in the art will recognize that numerous modifications are possible. For example, the methods and processes described herein may be implemented using hardware components, software components, and/or any combination thereof. Further, while various methods and processes described herein may be described with respect to particular structural and/or functional components for ease of description, methods provided by various embodiments are not limited to any particular structural and/or functional architecture but instead can be implemented on any suitable hardware, firmware and/or software configuration. Similarly, while certain functionality is ascribed to certain system components, unless the context dictates otherwise, this functionality can be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Moreover, the procedures described with respect to one method or process may be incorporated within other described methods or processes; likewise, system components described according to a particular structural architecture and/or with respect to one system may be organized in alternative structural architectures and/or incorporated within other described systems. Hence, while various embodiments are described with—or without—certain features for ease of description and to illustrate exemplary aspects of those embodiments, the various components and/or features described herein with respect to a particular embodiment can be substituted, added and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. An apparatus, comprising:

a gimbal, the gimbal comprising:

a first joint configured to allow rotation about a first axis;

a second joint configured to allow rotation about a second axis, the second joint coupled to the first joint via a first member; and a mount coupled to the second joint via a second member, wherein the first joint and the second joint are configured to allow the mount to pivot about the first axis and the second axis;

a first antenna coupled to the mount of the gimbal, the first antenna including one or more first antenna elements; and one or more counterbalances coupled to the mount of the gimbal, wherein at least one of the one or more first antenna elements and at least one counterbalance of the one or more counterbalances are disposed on opposite sides of the mount substantially equidistant from a center of the mount.

2. The apparatus of claim 1, wherein the gimbal includes a base coupled to the first joint, wherein the base is further coupled to a pole, and wherein the base is configured to be translated vertically relative to the pole.

3. The apparatus of claim 1, wherein the gimbal further comprises a third joint coupled to the first joint via a third member, wherein the third joint is configured to rotate about a third axis.

4. The apparatus of claim 1, further comprising a counterweight coupled to the mount, the counterweight configured to shift a center of gravity of the gimbal to a point between the mount and an end of the counterweight, and mitigate changes in an orientation of the first antenna.

5. The apparatus of claim 1, wherein the at least one antenna element of the one or more first antenna elements and the at least one counterbalance of the one or more counterbalances are configured to offset wind load about the center of the mount.

6. The apparatus of claim 1, wherein the at least one antenna element of the one or more first antenna elements and the at least one counterbalance of the one or more counterbalances are identical in at least one of size, shape, and weight.

7. The apparatus of claim 1, wherein the one or more counterbalances are at least one of one or more second antennas or one or more second antenna elements, wherein the at least one antenna element of one or more first antenna elements and the at least one counterbalance of the one or more counterbalances are at least one of spatially diverse, pattern diverse, polarization diverse, or transmit/receive diverse.

8. The apparatus of claim 1, wherein the first antenna comprises a plurality of lateral patch antennas, a plurality of arrays of patch antennas, one or more micro-strip patch antennas, a two-dimensional ("2D") leaky waveguide antenna, a three-dimensional ("3D") array of the one or more first antenna elements, or a parabolic antenna.

9. The apparatus of claim 1, further comprising:

a first driver operably coupled to the first joint;

a second driver operably coupled to the second joint;

wherein the first driver is configured to cause the first joint to rotate about the first axis and the second driver is configured to cause the second joint to rotate about the second axis, wherein the first driver and second driver are configured to mitigate changes to at least one of an orientation of the antenna or a position of the antenna, wherein mitigating changes to the orientation of the antenna includes compensating for changes in at least one of a yaw, a roll, or a pitch of the antenna.

10. The apparatus of claim 5, further comprising:

one or more sensors coupled to the gimbal; and a controller communicatively coupled to the one or more sensors and the first driver and the second driver, the controller receiving input from the one or more sensors about the orientation of the antenna, the controller further configured to actuate at least one of the first driver or the second driver to at least one of a target position or a target orientation of the antenna.

11. The apparatus of claim 10, further comprising:

a base coupled to the first joint via a third member, wherein the base is coupled to a pole, wherein a position or orientation of the antenna changes in response to a swaying of the pole, and wherein the controller is configured to mitigate changes from the at least one of the target position or target orientation of the antenna in response to the swaying of the pole.

12. A method comprising:

providing a gimbal, wherein the gimbal comprises a first joint configured to allow rotation about a first axis, a second joint configured to allow rotation about a second axis, the second joint coupled to the first joint via a first member, and a mount coupled to the second joint via a second member, wherein the first joint and second joint are configured to allow the mount to pivot about the first axis and the second axis;

mounting an antenna to the mount of the gimbal, the antenna including one or more antenna elements; and mounting one or more counterbalances to the mount of the gimbal, wherein at least one of the one or more first antenna elements and at least one counterbalance of the one or more counterbalances are disposed on opposite sides of the mount substantially equidistant from a center of the mount.

13. The method of claim 12 further comprising:

mounting the gimbal to at least one of a building, a tower, a pole, a tree, a wire, a cable, or a support line.

* * * * *